US007204578B2

(12) United States Patent
Harvey et al.

(10) Patent No.: US 7,204,578 B2
(45) Date of Patent: Apr. 17, 2007

(54) DROPLET DEPOSITION APPARATUS

(75) Inventors: Robert Harvey, Cambridge (GB); Stephen Temple, Cambridge (GB); Howard J. Manning, Edinburgh (GB); Salhadin Omer, Cambridge (GB)

(73) Assignee: Xaar Technology Limited, Cambridge (GB)

( * ) Notice: Subject to any disclaimer, the term of this patent is extended or adjusted under 35 U.S.C. 154(b) by 345 days.

(21) Appl. No.: 10/488,620

(22) PCT Filed: Sep. 9, 2002

(86) PCT No.: PCT/GB02/04078

§ 371 (c)(1),
(2), (4) Date: Sep. 29, 2004

(87) PCT Pub. No.: WO03/022587

PCT Pub. Date: Mar. 20, 2003

(65) Prior Publication Data

US 2005/0134651 A1 Jun. 23, 2005

(30) Foreign Application Priority Data

Sep. 7, 2001 (GB) ..... 0121619.1

(51) Int. Cl.
*B41J 2/145* (2006.01)
*B41J 2/15* (2006.01)

(52) U.S. Cl. ..... 347/40

(58) Field of Classification Search ..... None
See application file for complete search history.

(56) References Cited

U.S. PATENT DOCUMENTS 6,428,145 B1 * 8/2002 Feinn et al. ..... 347/50
6,869,167 B2 * 3/2005 Silverbrook ..... 347/49

FOREIGN PATENT DOCUMENTS

| | | |
|---|---|---|
| EP | 277 703 A1 | 8/1988 |
| EP | 278 590 A1 | 8/1988 |
| EP | 575 983 A2 | 12/1993 |
| EP | 575 983 A3 | 12/1993 |
| EP | 0 839 656 | 5/1998 |
| WO | WO 00/24584 | 5/2000 |
| WO | WO 00/29217 | 5/2000 |
| WO | WO 00/38928 | 7/2000 |

OTHER PUBLICATIONS

International Search Report in PCT/GB02/04078 dated Dec. 10, 2002.

* cited by examiner

*Primary Examiner*—Thinh Nguyen
(74) *Attorney, Agent, or Firm*—Marshall, Gerstein & Borun LLP

(57) ABSTRACT

A hollow cylindrical support for a plurality of flow-through inkjet print heads has two folded wall sections cooperating to define elongate inlet and outlet ink manifolds, one wall section being thermally conducting so as to promote heat transfer along the length of the support, the other wall section being thermally insulating so as to inhibit heat transfer between the inlet and outlet manifolds. The thermally insulating section serves to trap a boundary layer of fluid, for example in a cavity wall or cellular material.

31 Claims, 10 Drawing Sheets

DROPLET DEPOSITION APPARATUS

This is the U.S. national phase of International Application No. PCT/GB02/04078 filed Sep. 9, 2002, the entire disclosure of which is incorporated herein by reference.

The present invention relates to printers and in particular droplet deposition ink jet printers Ink jet printers are no longer viewed simply as office printers, their versatility means that they are now used in digital presses and other industrial markets. It is not uncommon for print heads to contain in excess of 500 nozzles and it is anticipated that "page wide" print heads containing over 2000 nozzles will be commercially available in the near future.

A support suitable for use for a page wide print head is described in WO 00/24584 (incorporated herein). The support is formed of extruded aluminium and has a footprint of a similar size to that of the print head to which it is attached. This allows a number of arrays to be arranged in parallel to one another at a relatively close spacing. The close spacing is necessary to minimise effects caused by paper travel and to ease alignment.

A support of this general nature has a number of useful advantages.

It is an objective of WO 00/24584 to improve the thermal management of the page wide print head. Heat is generated in the drive circuits and is conveniently allowed pass into the ink through the support. The ink circulates continuously through the head and the support at a flow rate around ten times the maximum printing rate. The drive circuits are located adjacent the outlet manifold to avoid heating the ink entering the ejection channels and this allows the ink in the inlet manifold to remain at a substantially uniform temperature.

A print head is mounted to the support of WO 00/24584 and is continually supplied with ink from the ink inlet manifold. The print head itself is formed of a number of parallel channels having sidewalls of a piezoelectric material. The sidewalls are polarised such that an applied electric field causes them to deflect in shear and pressurise the ink within the ejection channels. EP 0 277 703, EP 0 278 590 and WO 00/29217 (incorporated herein) describe such an apparatus and consequently it will not be discussed in any more detail in this application.

As the ink flows continually through the channels, any heat generated by the piezoelectric material is absorbed into the ink and removed from the head.

For ease of manufacture and cost reasons, the support of the prior art is formed of extruded aluminium and is sized such that there is substantially even distribution of heat along its length. This reduces thermally-induced strains that might otherwise distort the print head. Such distortion would become more pronounced as the width of the print head increases, for example to that of a page (typically 12.6 inches (32 cm) for the American "Foolscap" standard) and would occur regardless of whether a plurality of narrow ejection units or a single wide ejection unit were used in conjunction with the support member.

It is an object of the present invention to further improve thermal management and temperature uniformity along a support and to address other associated problems.

Accordingly, the present invention consists in one aspect in an elongate support for a plurality of inkjet print heads each demanding in use a continuous flow of ink, said support providing a mounting surface which is arranged to receive print heads spaced along the length of the support and which provides ink inlet and outlet ports for communication with the respective print heads, the support comprising at least two wall sections, each extending with constant cross section over a substantial portion of the length of the support, the wall sections cooperating to define elongate inlet and outlet ink manifolds, one wall section being thermally conducting so as to promote heat transfer along the length of the support, another wall section being thermally insulating so as to inhibit heat transfer between the inlet and outlet manifolds.

Preferably the respective thermally conducting and thermally insulating wall sections are formed from different materials, such as metal and plastics.

Advantageously, the wall sections are folded with one of the wall sections suitably being U-shaped in the cross section of the support.

In one form of the invention, the thermally insulating wall section defines a phase barrier, such as an air filled cavity wall or cellular structure or a trapped layer of ink or other fluid.

In another aspect, the present invention consists in support apparatus for an inkjet print head, said support taking the form of a generally hollow cylinder and defining an ink inlet manifold and an ink outlet manifold each extending parallel to the axis of the support, there being means for insulating said manifolds from each other to reduce heat transfer therebetween.

Preferably the insulating means comprises a wall separating said ink inlet manifold from said ink outlet manifold. The arrangement can be such that both the ink inlet manifold and ink outlet manifolds extend substantially the length of the support and are enclosed by a perimeter. In this arrangement it is preferred that the perimeter forms at least part of said ink outlet manifold and the wall separating the inlet and outlet manifolds is formed of a material having a lower heat transfer coefficient than said perimeter. This material may be plastic, rigid foam or any other appropriate material.

Alternatively, the insulating means may be located adjacent at least one side of said wall and may be a material having a lower coefficient of thermal conduction than the remainder of said wall. By moulding baffles or roughening the walls it is a possible to create a thick boundary layer such that the fluid in the manifolds provides the insulation.

In an alternative embodiment a cavity wall is provided that allows for a greater range of insulation to be used including gasses, other liquids or even a vacuum. The fluid material within said cavity can be pressurised and the walls of said cavity wall flexible to accommodate said fluid material over a range of pressures.

In a further embodiment the insulating means comprises a heat sink disposed within one of said manifolds. This extends substantially the entire length of said one of said manifolds and ensures that the heat transfer along the support is significantly greater that the heat transfer between the outlet and inlet manifolds.

In yet a further aspect, the present invention consists in a support for an inkjet print head demanding in use a continuous flow of ink, said support providing a mounting surface which is arranged to receive at least one print head and which provides ink inlet and outlet ports for communication with the print head or heads, the support comprising at least two wall sections cooperating to define inlet and outlet ink manifolds, one wall section being formed of a thermally conducting material so as to promote heat transfer, another wall section being formed of a different material and being thermally insulating so as to inhibit heat transfer between the inlet and outlet manifolds.

In all these embodiments it is preferred that the ink inlet and ink outlet manifolds are fluidically connected through a print head mounted onto the support. It is even more preferable that the fluid connection is through the ejection channels of the print head.

The invention will now be described, by way of example only, with reference to the following diagrams in which.

Figure 1:
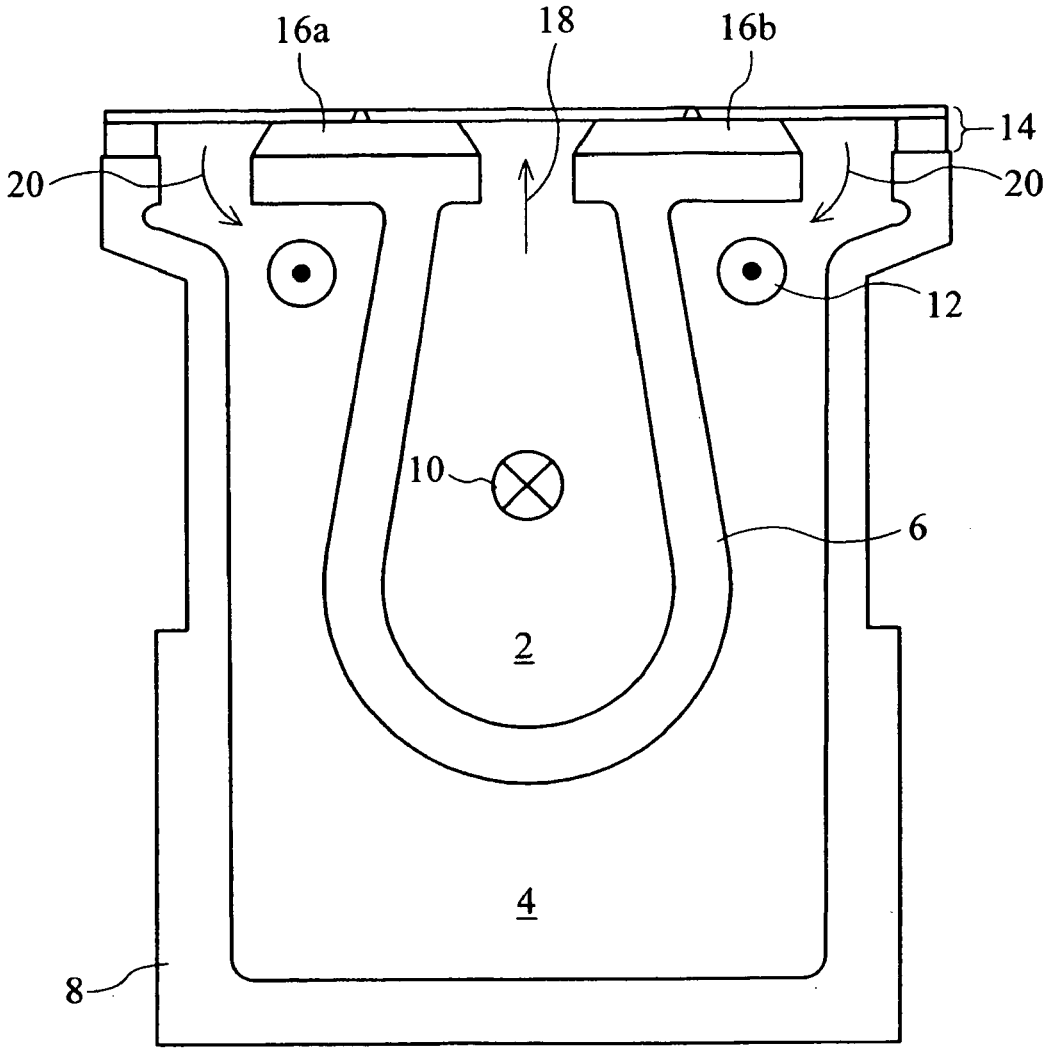
FIG. 1 depicts an ink supply support according to the prior art.

FIG. 1 depicts an ink supply support according to the prior art. The support is formed of extruded aluminium and consists of two separate manifolds 2, 4 that extend substantially the length of the support. The wall 6 dividing the two manifolds is thus formed of the same material as the exterior wall of the support.

Ink enters and leaves through ports (not shown) situated at one end of the support. The ink flows down the inner manifold 2 in one direction as depicted by the symbol 10 and flows back down the outer manifold in the opposite direction as depicted by the symbol 12.

The inner and outer manifolds 2, 4 are connected through a print head 14 attached to the top of the support. Two arrays of piezoelectric material containing sawn parallel channels 16*a*, 16*b* provide the ejection energy. Ink is supplied simultaneously to both arrays from a central manifold in the direction of arrow 18 and returns to the outer manifold of the support after passing through the ejection channel as shown by the arrow 20.

In the ideal thermal situation, the ink should enter the support at a well-controlled temperature, pass along the inlet manifold at the same temperature, flow through the channels picking up heat from the PZT, and leave via the outlet manifolds at a uniform but higher temperature.

In practice, when a channel is printing, the PZT dissipates considerable heat, some of which is removed with the ejected drops. When the channel is not printing, the PZT may be doing nothing. Constant temperature waveforms which are applied to the non ejecting channels and cause the PZT to dissipate that part of the heat generated during printing which is not removed by the ejected droplets are used to maintain the temperature within the channels at a constant temperature along the entire array.

The chips also generate heat, the amount depending on the firing voltage and (to a lesser extent) on the image being printed. The chips require cooling and thus have been situated so that this heat finds its way into the outlet manifold 4.

The aluminium chassis that forms the support provides a conduction path that attempts to equalise temperatures along the array. Ink flow along the array assists in the distribution of heat.

Heat dissipated by the PZT is of the order of 0.015 W/channel, and the chips dissipate a similar amount. If all of this heat were to go into the ink through flow then the temperature rise of the ink in passing through the PWA would be 5.40 C.

The amount of heat removed during full black printing is 0.0015 W/channel, that is to say a small fraction of the total heat dissipation. When the printing is lighter than full black, the removal of heat by the drops is even less significant. Heat losses from the print head to the surroundings are modest and any covers protecting the electronics act to further reduce the heat loss.

Figure 2:
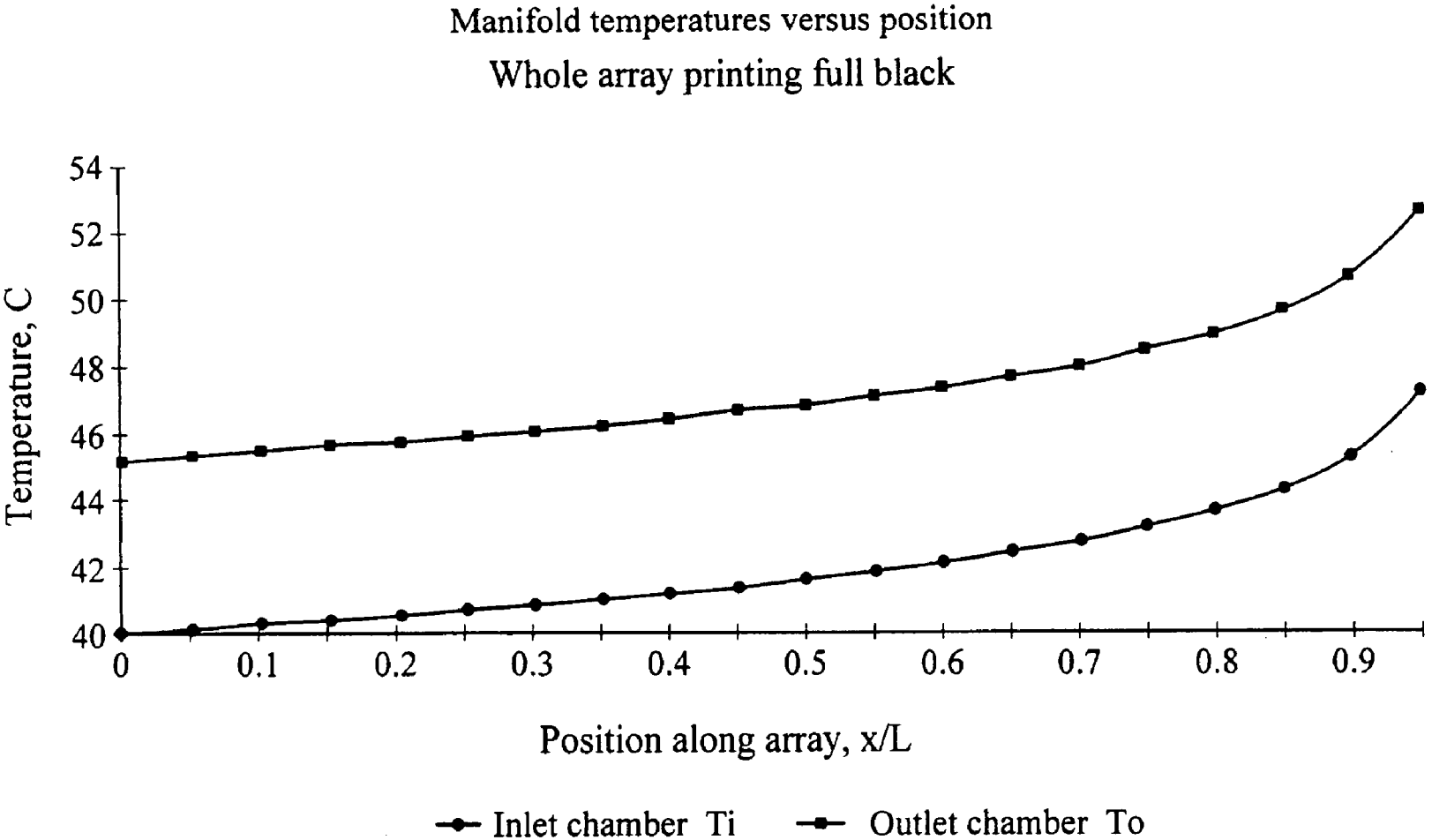
FIG. 2 is a graph showing the temperature of the ink inlet and ink outlet manifolds along the length of a page wide array.

It has been found that the aluminium chassis has the disadvantageous feature of transferring a significant amount of heat from the outlet manifold to the inlet manifold as well as the advantageous feature of transferring heat along the length of the support. Taking a temperature difference of 5.40 C, and a heat transfer coefficient of 1000 $W/m^2$ C, the heat transferred through two walls, each 30 mm high and running the length of the array, is 52 watts. Effectively, the print head is operating as a counter current heat exchanger, the aluminium chassis and the ink being unable to completely equalise the temperature difference along the array. FIG. 2 is a graphical representation of the temperature difference along the print head support.

In one aspect of the present invention, as depicted in FIGS. 3 to 6, the support is modified such that the heat transfer coefficient between the ink inlet manifold and the ink outlet manifold is less than that of the prior art.

Figure 3:
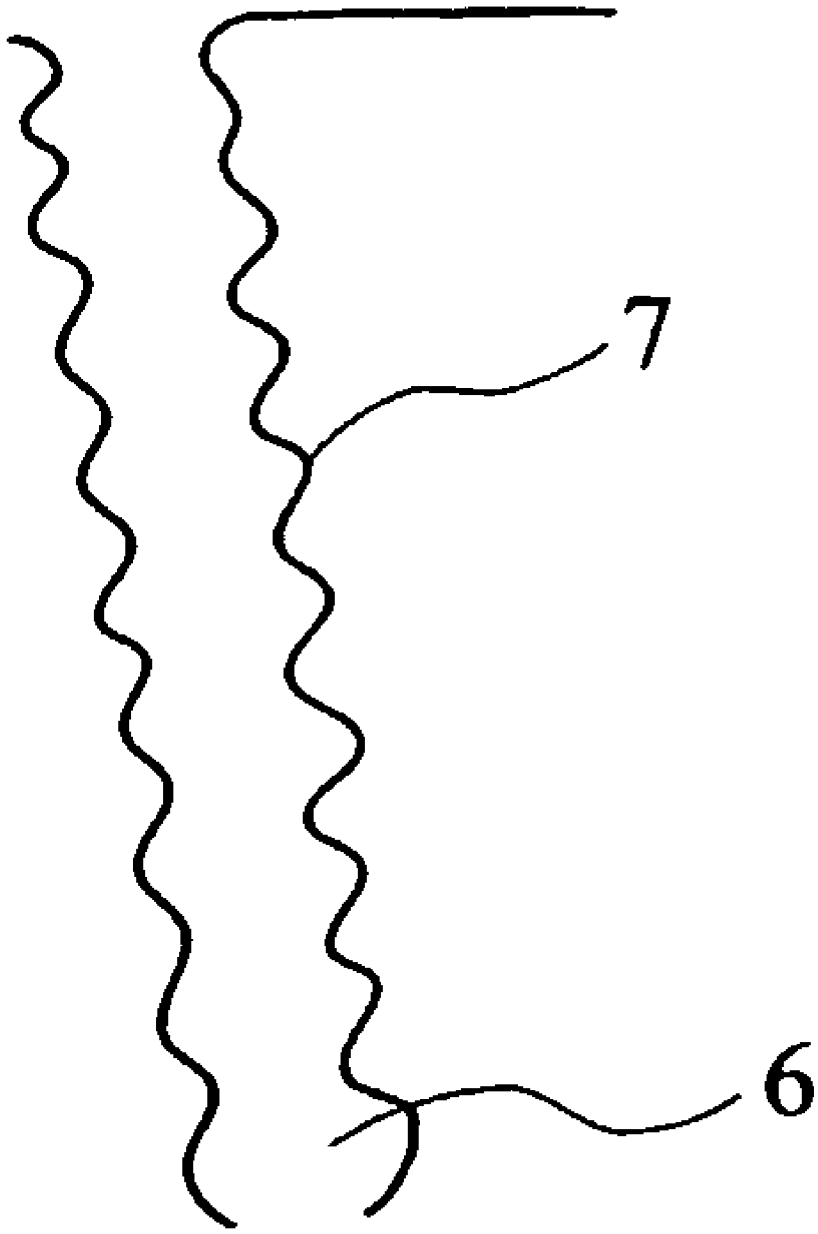
FIG. 3 shows a dividing wall having a roughened surface.
Figure 4:
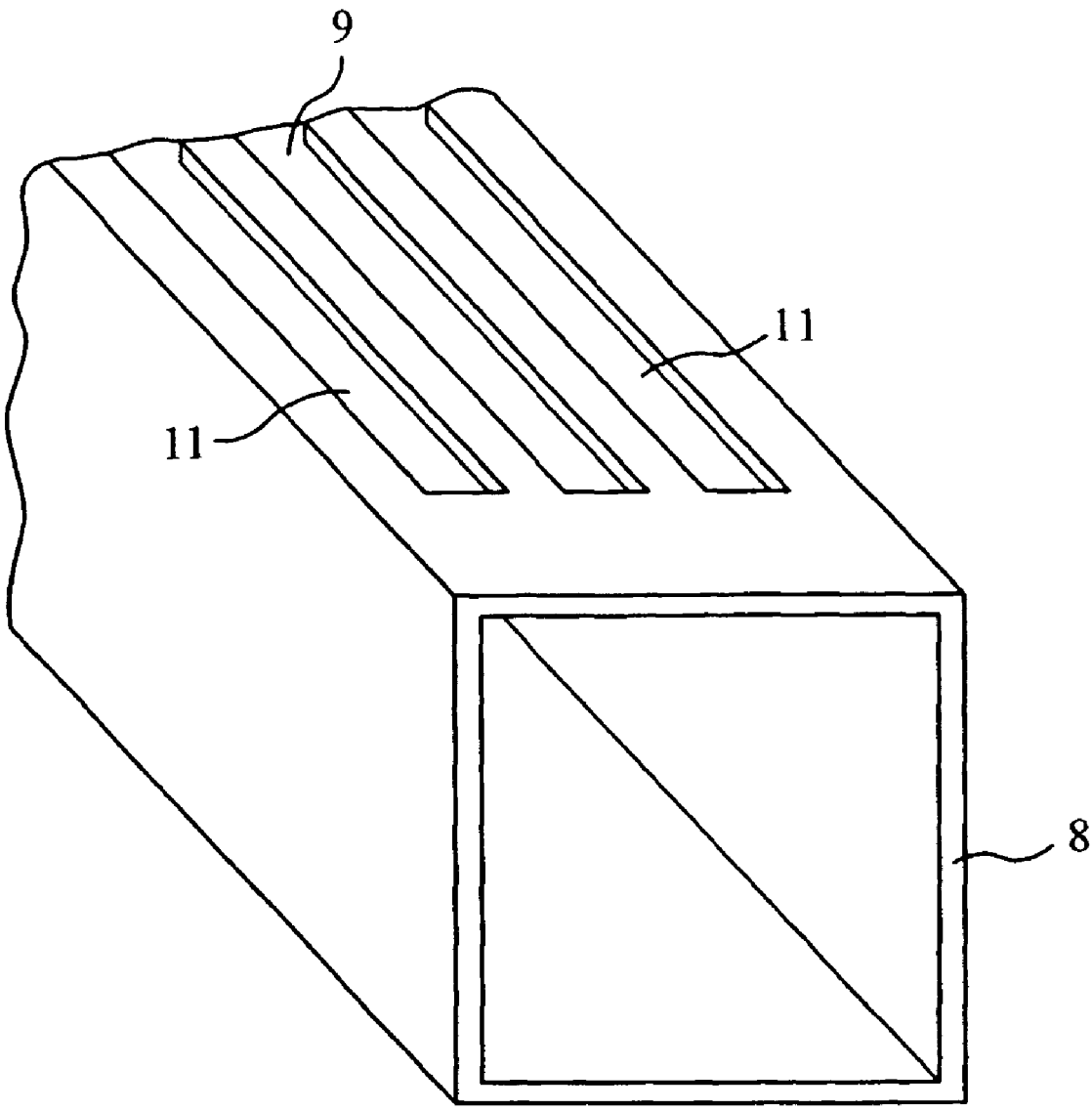
FIG. 4 is a simplified support.

A number of methods have been found to be suitable. In a first embodiment as shown in FIG. 3, the divider separating the two conduits is a wall that is roughened or shaped so as to provide a thick boundary or stagnant layer. Where corrugation is used, the ridges 7 can extend either parallel to or perpendicular to the direction of fluid flow. In this case, where the support is extruded, the ridges extend parallel to the direction of fluid flow. Alternatively, an insulating coating can be applied to one or both sides of the dividing wall.

In these embodiments the divider can be formed from the same material as the extruded perimeter. It is of course possible to use other materials as the dividing wall as described in the alternative embodiments of the first embodiment and as depicted in FIGS. 4 to 7.

It is known that the difference in the coefficient of thermal expansion between PZT and the aluminium causes problems during operation. In the prior art excess expansion of the aluminium is prevented through the provision of tie-rods and the like. Aluminium is used because it is cheap and it is easy to form an extruded component with the manifolds and dividing walls in place.

In FIG. 3, a ceramic support is used. Ceramics cannot be extruded to the same amount of complexity as aluminium, but simple structures are possible. The ceramic has a similar coefficient of thermal expansion to the piezoelectric actuator and thus inappropriate expansion differences are not present.

Figure 5:
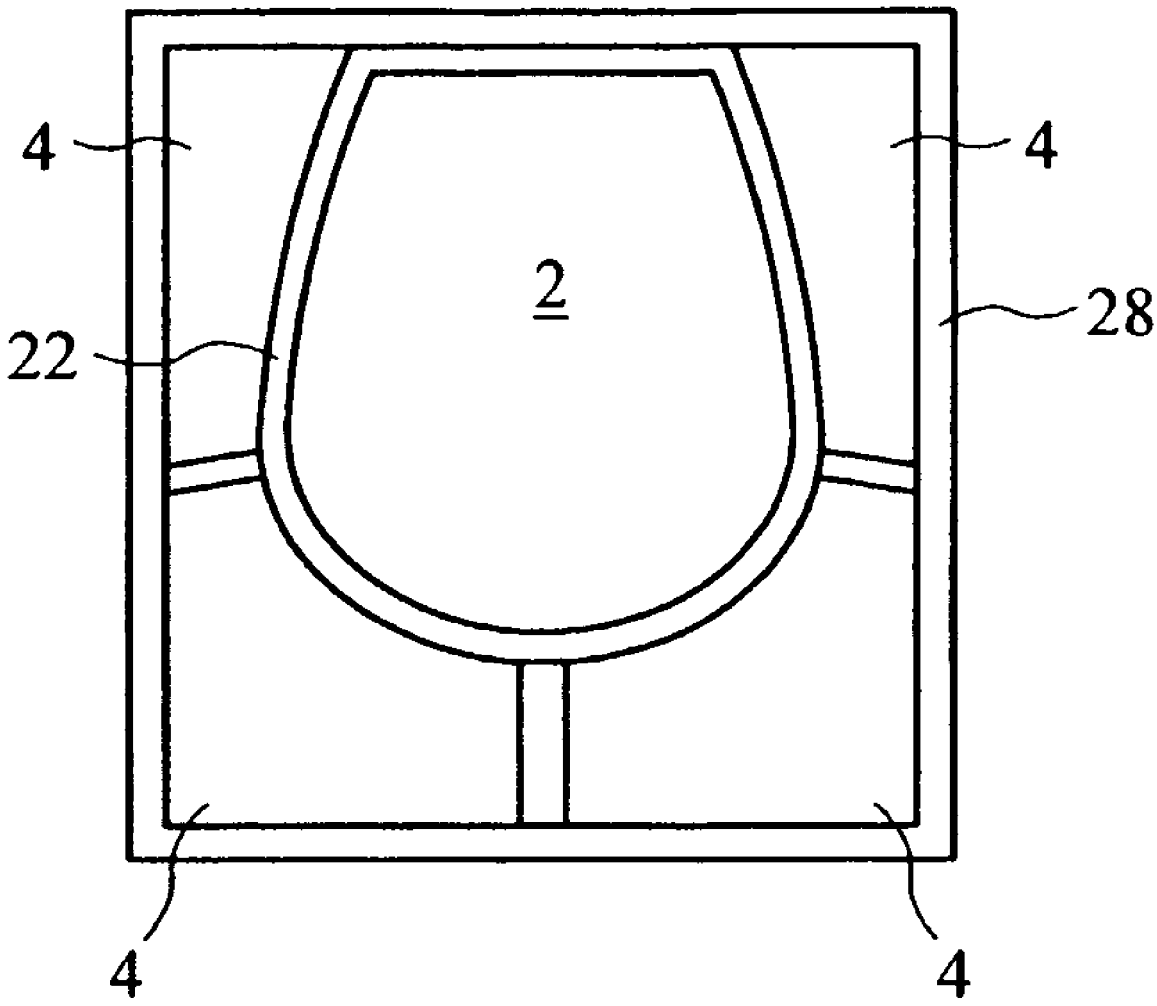
FIG. 5 is the end view of the support of FIG. 3 containing a separator.

The inlet 9 and outlet 11 manifolds for the print head are formed by etching, sawing or ablation. Because an insert will be attached to the inside of the support to provide the flow features, it is not necessary to manufacture the slots to as high a degree of tolerance as in the aluminium support. The features of the manifolds are provided by an insert that acts as an insulator between the inlet 2 and the outlet manifolds 4 as shown in FIG. 5.

The plastic inset 22 is adhesively attached to the upper surface of the supply support 28. Spacers 24 are used to ensure there is no adverse movement of the spacer. In certain circumstances it is beneficial to provide baffles, ridges or a roughened surface to increase the boundary layer of ink around the dividing wall and to provide additional insulation. Alternatively, as the insert can be manufactured by moulding or casting, a double wall may be formed and which provides an insulating air cavity.

The plastic wall may be replaced by a closed-cell foam rubber wall, chosen to be resistant to chemical attack by the ink, capable of being formed into an appropriate shape and which does not shed dirt particles into the ink. Other materials are also possible without departing from the scope of the present invention.

Figure 6:
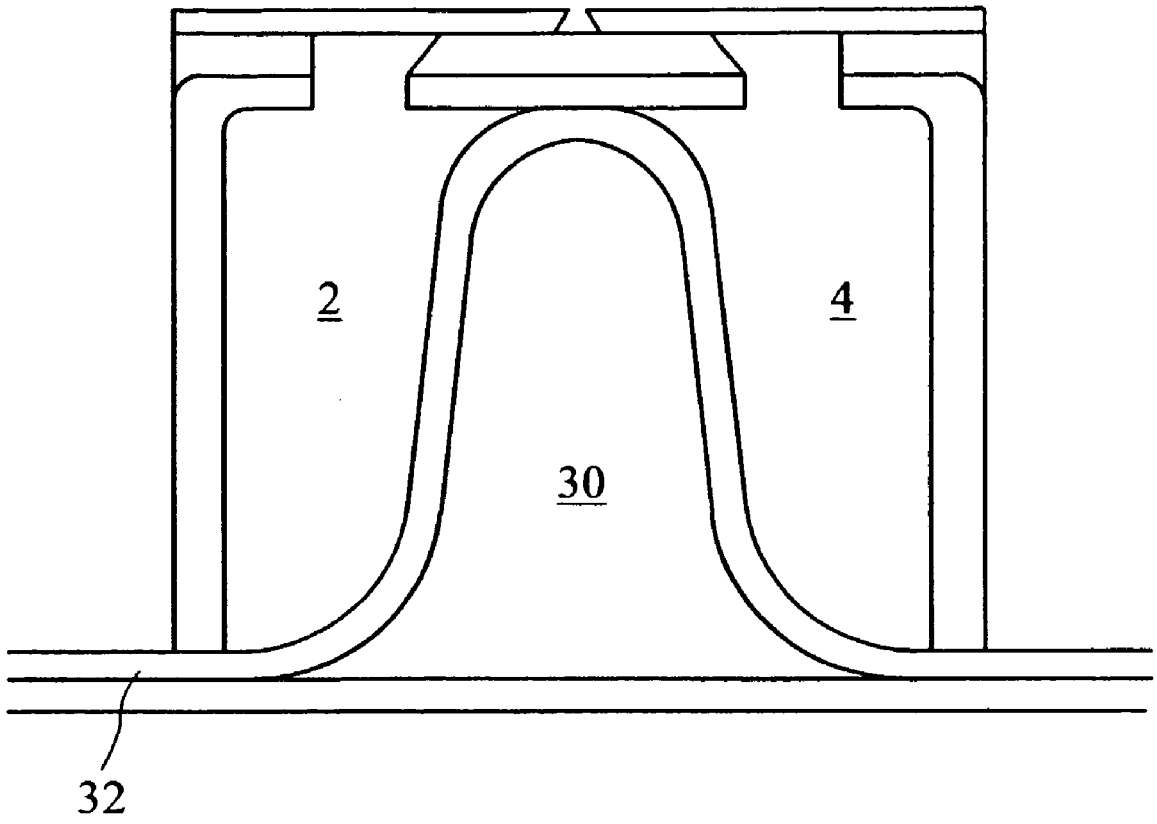
FIG. 6 is an end view of a support for a single row print head having air insulation between the inlet and outlet manifolds.

FIG. 6 shows a single row print head formed on a support. The piezoelectric material 16*a* provides a flow circuit between an inlet manifold 2 and an outlet manifold 4. The manifolds are separated by a plastic material formed such that there is a cavity 30 between them.

The cavity is filled with a fluid, preferably gaseous, or a vacuum in order to provide insulation between the two manifolds. The dividing wall is attached to the support at least one point and may be rigid or flexible. Where the wall is flexible, a source of pressurised fluid can be used to change the pressures within the manifolds. A 3 mm gap of air reduces the difference along a 20 cm array to below.

Figure 7:
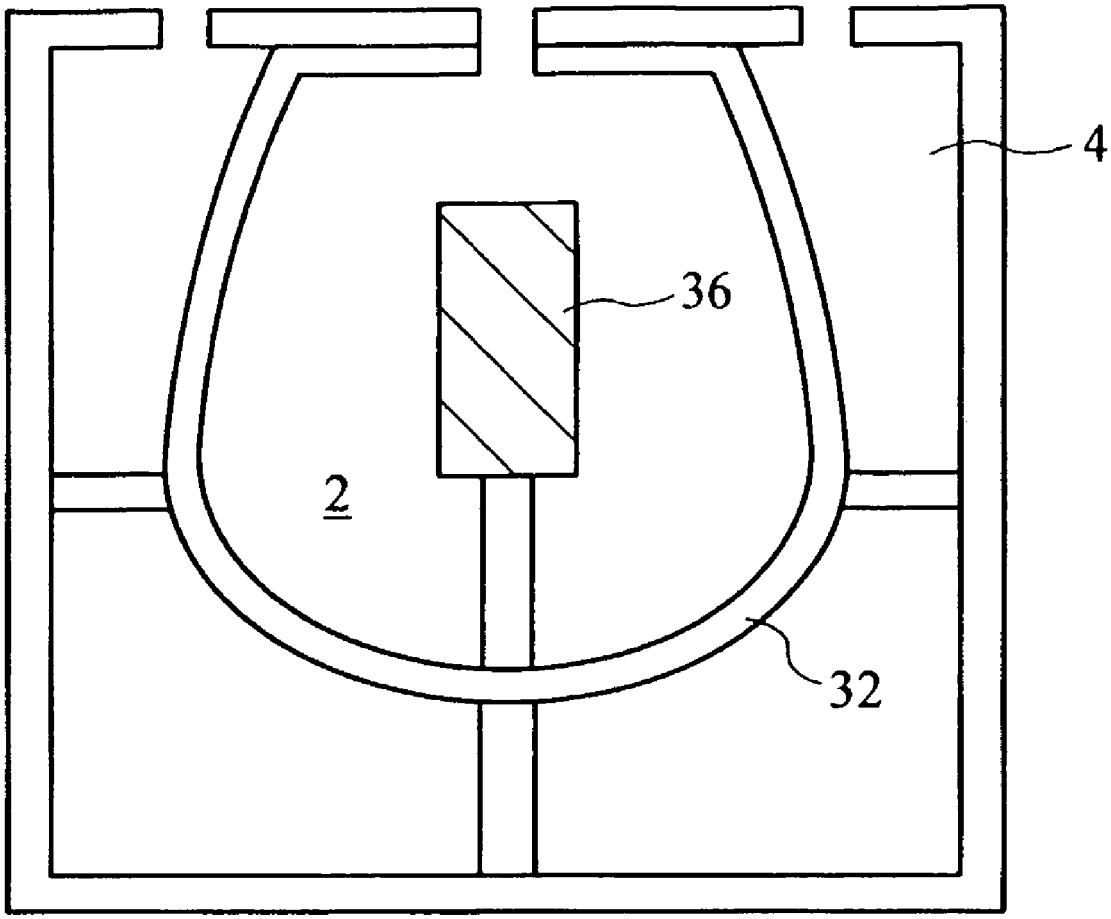
FIG. 7 is an end view of a support containing a thermal bar.

A further method of improving the distribution of heat along the support, rather than across the walls is to provide a highly conductive heat transfer bar within one of the manifolds as depicted in FIG. 7. The bar 36 can extend beyond the edge of the support and attached to an external heat exchanger, or alternatively it may be contained fully within the support. In this embodiment of the present invention the heat transfer along the array is increased to the point where the transfer across the divider separating the inlet and outlet manifolds becomes insignificant.

Figure 8:
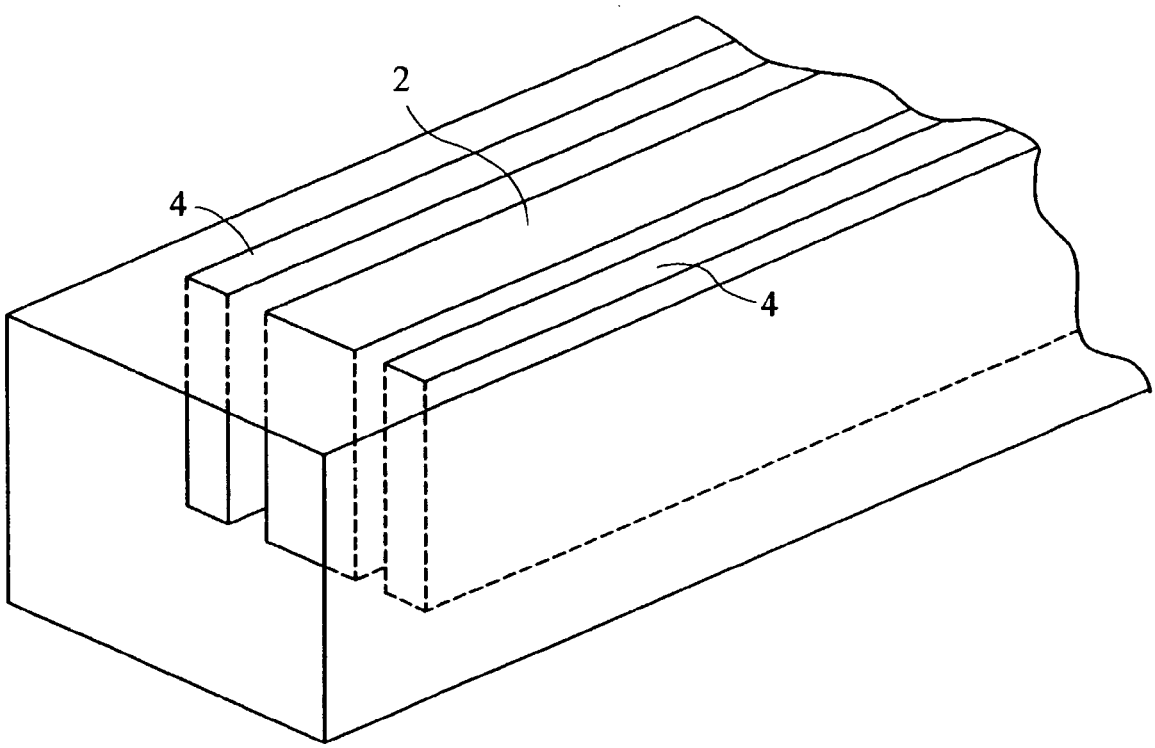
FIG. 8 is a perspective view of a support according to a further embodiment of the invention.

FIG. 8 depicts a further design of manifold that is preferably formed of a moulded material, the manifold component having an inlet 2 and two outlet manifolds 4. As the manifolds are moulded it is possible to mould a double wall dividing the inlet and outlet manifolds. The double wall comprises a cavity of air that acts as an insulator reducing the amount of heat transfer across the wall.

Figure 9:
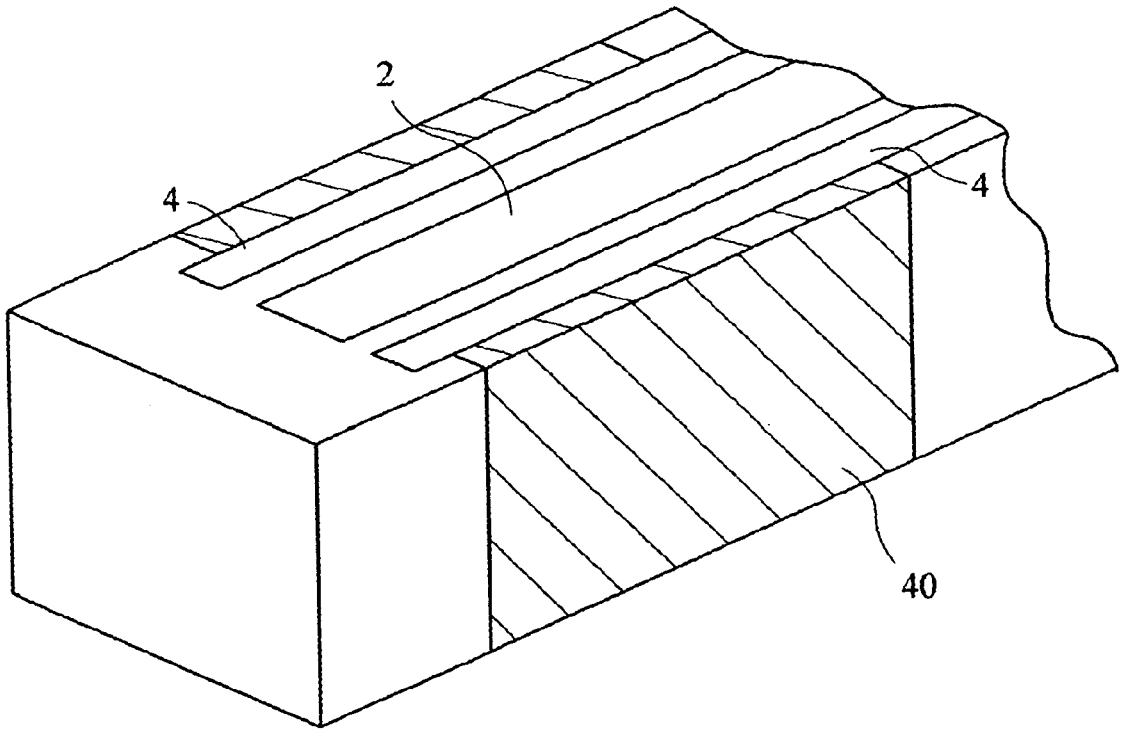
FIG. 9 is a view similar to FIG. 8 illustrating a modification.

One of the purposes of the manifold component is to receive the heat from the driver chips bonded to its outer surfaces. Where the plastics material of the component has a low thermal conductivity this heat transfer is reduced. A metallic, or other higher thermally conductive material 40 may be moulded into the component during manufacture as shown in FIG. 9. This allows heat transfer between the chip and the outlet manifold whilst still providing insulation to the inner manifold.

An alternative to this is to mould the majority of the manifold component in a material having a relatively high thermal conductivity and to mould the walls dividing the inlet and outlet manifolds in a material of low thermal conductivity.

Figure 10:
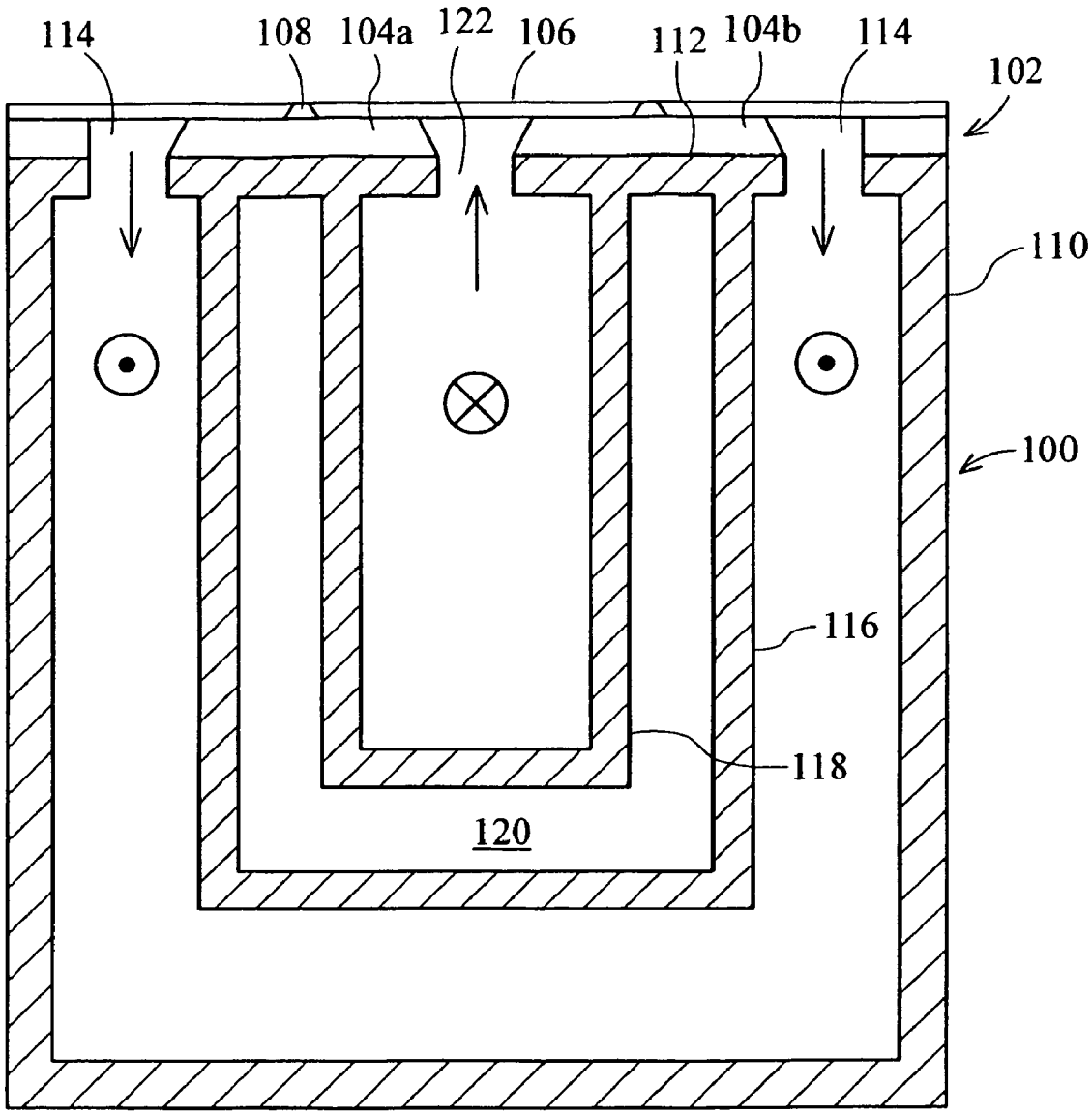
FIG. 10 is a sectional view of a support according to yet a further embodiment of the invention.

In the structure shown in FIG. 10, a hollow, cylindrical support 100 serves to mount a plurality of ink jet print heads 102. The support 100 has a external wall section 110, folded into a U-shape. The support provides a mounting surface 112 on which are supported the print heads, each of which comprises a layer of piezoelectric material 104 defining ink channels extending across the support and a cover plate 106 defining nozzles 108.

In the section shown in FIG. 10, two ink channels are defined by respective sections 104*a* and 104*b* of the piezoelectric layer. In use, ink flowing through inlet port 122 in the mounting surface flows continuously in opposing transverse directions through the two ink channels to be collected by respective outlet ports 114.

The outlet ports 114 communicate with an outlet ink manifold defined by the external wall section 110.

An internal wall section takes the form of double walls 116 and 118 defining between them a thermally insulating cavity 120. This cavity may contain air at atmospheric material, be evacuated or contain trapped ink or other appropriate liquid. The cavity may be filled with foam or other cellular material.

The inlet ink manifold defined by the cavity wall 116,118 communicates with the ink inlet port 122.

The structure shown in FIG. 10, may be formed in one piece by—for example—extrusion or moulding or by a range of other forming techniques. In one example, the structure is formed of extruded aluminium or other suitable metal. In another example the structure is formed of moulded plastic. Optionally, in this example, an additional wall section is provided of metal or metal loaded plastic to promote heat transfer along the length of the support. In other examples, the structure is formed from wall sections of different material.

In one example, a port plate (not shown) is interposed between the wall sections and the print heads to assist in defining the ink inlet and outlet ports. In this arrangement, openings defined with relatively low precision by the cooperating wall sections, communicate with more precisely defined port openings in the interposed plate. According to the manufacturing process, this port plate may form part of the support or part of the print head.

Each feature disclosed in this specification (which term includes the claims) and/or shown in the drawings may be incorporated in the invention independent of or in combination with other disclosed and/or illustrated features.

The invention claimed is:

1. An elongate support for a plurality of inkjet print heads each demanding in use a continuous flow of ink, said support providing a mounting surface which is arranged to receive print heads spaced along the length of the support and which provides ink inlet and outlet ports for communication with the respective print heads, the support comprising at least two wall sections, each extending with constant cross section over a substantial portion of the length of the support, the wall sections cooperating to define elongate inlet and outlet ink manifolds, one wall section being thermally conducting so as to promote heat transfer along the length of the support, another wall section being thermally insulating so as to inhibit heat transfer between the inlet and outlet manifolds.

2. A support according to claim 1, wherein the respective thermally conducting and thermally insulating wall sections are formed from different materials.

3. A support according to claim 1, wherein the thermally conducting wall section is formed from metal.

4. A support according to claim 1, wherein the wall sections are folded.

5. A support according to claim 4, wherein at least one of the wall sections is U-shaped in the cross section of the support.

6. A support according to claim 1, wherein the thermally insulating wall section defines a phase barrier.

7. A support according to claim 6, wherein the thermally insulating wall section defines an air gap.

8. A support according to claim 1, wherein the thermally insulating wall section serves to trap fluid.

9. A support according to claim 8, wherein the thermally insulating wall section comprises a double wall arrangement.

10. A support according to claim 8, wherein the thermally insulating wall section is formed of cellular material.

11. A support according to claim 1, wherein in the cross section of the support, one ink manifold substantially surrounds the other ink manifold.

12. A support according to claim 1, wherein the thermally conducting wall section extends within one of the ink manifolds.

13. Support apparatus for an inkjet print head, said support apparatus comprising a generally hollow cylinder having a cylindrical axis, an ink inlet manifold and an ink outlet manifold each provided in said cylinder and each extending parallel to said axis, and means for insulating said manifolds from each other to reduce heat transfer therebetween.

14. Apparatus according to claim 13, wherein said insulating means comprises a wall separating said ink inlet manifold from said ink outlet manifold.

15. Apparatus according to claim 14, wherein said wall is formed of plastic material.

16. Apparatus according to claim 14, wherein adjacent to at least one side of said wall a material is provided having a lower coefficient of thermal conduction than the remainder of said wall.

17. Apparatus according to claim 16, wherein said material is a layer of fluid.

18. Apparatus according to claim 17, wherein said fluid is gaseous.

19. Apparatus according to claim 14, wherein said wall comprises a cavity wall.

20. Apparatus according to claim 19, wherein fluid material within said cavity is pressurized, the walls of said cavity wall being flexible to accommodate said fluid material over a range of pressures.

21. Apparatus according to claim 14, further comprising a heat sink disposed within one of said manifolds.

22. Apparatus according to claim 21, wherein said heat sink extends substantially the entire length of said one of said manifolds.

23. Apparatus comprising a support according to claim 13 and an ink jet print head comprising at least one fluid chamber, said inlet manifold and said outlet manifold being fluidically connected through said at least one fluid chamber.

24. Apparatus according to claim 23, wherein said at least one fluid chamber is an ejection chamber having an ejection nozzle.

25. A support for an inkjet print head demanding in use a continuous flow of ink, said support providing a mounting surface which is arranged to receive at least one print head and which provides ink inlet and outlet ports for communication with the print head or heads, the support comprising at least two wall sections cooperating to define inlet and outlet ink manifolds, one wall section being formed of a thermally conducting material so as to promote heat transfer, another wall section being formed of a different material and being thermally insulating so as to inhibit heat transfer between the inlet and outlet manifolds.

26. A support according to claim 25, wherein the thermally conducting wall section is formed from metal.

27. A support according to claim 25, wherein the thermally insulating wall section is formed of cellular material.

28. A support according to claim 25, wherein in the cross section of the support, one ink manifold substantially surrounds the other.

29. A support according to claim 25, wherein said thermally insulating wall section is formed of plastics material.

30. Apparatus comprising a support according to claim 23 and an ink jet print head comprising at least one fluid chamber, said inlet manifold and said outlet manifold being fluidically connected through said at least one fluid chamber.

31. Apparatus according to claim 30, wherein said at least one fluid chamber is an ejection chamber having an ejection nozzle.

* * * * *